US005605381A

United States Patent [19]

Schmoock, Jr. et al.

[11] Patent Number: 5,605,381

[45] Date of Patent: Feb. 25, 1997

[54] PAVEMENT MARKING ERADICATOR

[75] Inventors: Carl J. Schmoock, Jr., Acworth; Quinton W. Robinson, Dallas, both of Ga.

[73] Assignee: Stimsonite Corporation, Atlanta, Ga.

[21] Appl. No.: 662,908

[22] Filed: Jun. 12, 1996

Related U.S. Application Data

[63] Continuation of Ser. No. 323,811, Oct. 17, 1994, abandoned.

[51] Int. Cl.[6] ..... E01C 23/08

[52] U.S. Cl. ..... 299/39.2; 299/41.1; 404/90; 404/94

[58] Field of Search ..... 299/36.1, 39.1, 299/39.2, 39.9, 41.1

[56] References Cited

U.S. PATENT DOCUMENTS

| | | | |
|---|---|---|---|
| 3,490,208 | 1/1970 | Meyer et al. | 15/340.2 |
| 3,548,436 | 12/1970 | Henrich | 15/3.53 |
| 3,979,789 | 9/1976 | Peabody et al. | 15/349 |
| 4,279,056 | 7/1981 | Jacobson, Jr. et al. | 15/79.2 X |
| 4,459,719 | 7/1984 | Notestine | 15/349 |
| 5,092,658 | 3/1992 | Smith | 299/39 |
| 5,167,215 | 12/1992 | Harding, Jr. | 125/13.01 |
| 5,215,071 | 6/1993 | Mertes et al. | 299/39 X |

OTHER PUBLICATIONS

Edco Dry Vac II Portable Dust Collection Sys., pp. 1–2.
Edco Vac Dust Free Surface Prep. & Concrete Cutting, pp. 1–4.
Airtec Roto–Tiger Power Floor Surfacer, p.1.
Bartell Dust Control Unit, p. 1.

*Primary Examiner*—James A. Lisehora
*Attorney, Agent, or Firm*—Ronald A. Sandler

[57] ABSTRACT

A pavement marking eradicator (10) for removing pavement marking from pavement. The eradicator has a grinding apparatus (13) having a safety skirt (31) to which is mounted a collector (39) of a vacuum system (14). The vacuum system also has a cyclone (36) for collecting and filtering debris created by the grinding apparatus during operation.

21 Claims, 3 Drawing Sheets

PAVEMENT MARKING ERADICATOR

This is a continuation of application Ser. No. 08/323,811 filed on Oct. 17, 1994, now abandoned.

TECHNICAL FIELD

The present invention relates generally to equipment used in maintaining roadways, and more particularly to eradicators used in removing markings on pavement.

BACKGROUND OF THE INVENTION

Eradicators are commonly used to remove pavement markings such as paint, thermoplastic, tapes and coatings on roadways for the designation of lanes, crosswalks and directional indicators. These eradicators operate by grinding the surface of the pavement thereby chipping away the pavement markings thereon. These eradicators typically include a metal protective skirt and a resilient shroud both of which prevent the scattering of debris, such as particles of paint and pavement material, from beneath the eradicator as the roadway surface is ground. This debris however remains upon the surface of the pavement and therefore must be manually collected and placed in containers suitable for proper disposal. Fine debris often becomes airborne in the form of dust.

Some pavement markings used in marking roadway lines typically contain pigment of hazardous material such as lead and heavy metals or chromium in its composition. The grinding of this type of pavement marking causes the hazardous material to be released, thus creating the possibility of exposure to those operating the eradicator as well as the general public and animals within the region. As these elements are considered to be hazardous materials, their proper collection and disposal is imperative and furthermore mandated by many government agencies with regard to its special handling and disposal.

Thus, there exists a need for a pavement marking eradicator for grinding pavement marking containing potentially hazardous material without the threat of exposing workers, the general public and animals to the hazardous material. Accordingly, it is to the provision of such that the present invention is primarily directed.

SUMMARY OF THE INVENTION

In a preferred form of the invention an eradicator is provided for removing pavement marking from pavement. The eradicator comprises a skirt at least partially defining a work chamber, a plurality of wheels supporting the skirt for movement over the pavement, and a grinder positioned within the work chamber. The eradicator also has a vacuum system in fluid communication with the work chamber, and a storage chamber in fluid communication with the vacuum system. With this construction, pavement marking ground from the surface of the pavement by the grinder is pulled into the vacuum system and deposited into the storage chamber for collection and subsequent disposal.

DETAILED DESCRIPTION OF THE DRAWINGS

Figure 1:
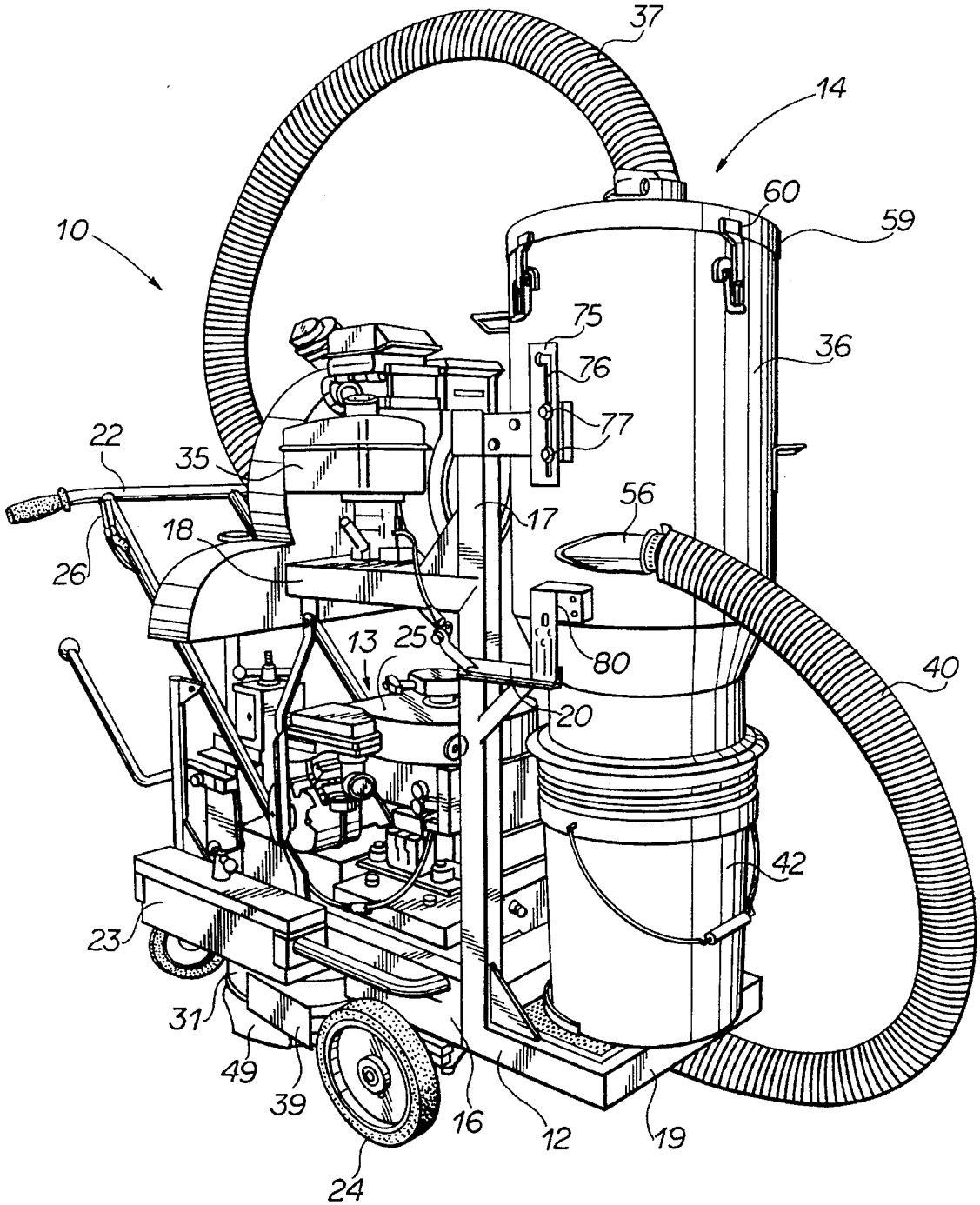
FIG. 1 is a perspective view of a pavement marking eradicator embodying principles of the invention in a preferred form.

Referring now in more detail to the drawings in which like numerals indicate like parts in the several views, FIG. 1 illustrates a pavement marking eradicator 10 having a frame 12, a grinding apparatus 13, and a vacuum system 14. The frame 12 has a substantially horizontal base portion 16 and an upright portion 17 extending from the base portion 16. The upright portion 17 includes an upper platform 18, a lower platform 19 and a pair of mounting arms 20. A handle 22, a pair of pivotable guide wheels 23 and a second pair of wheels 24 are mounted to the base portion 16.

The grinding apparatus 13 includes a motor 25 mounted on the base portion 16 which rotatably drives a grinding assembly 27. Motor 25 is controlled by a throttle 26 mounted to handle 22. The grinding assembly 27 itself has three radially extending arms 28 each having three rotating grinding wheels 29 mounted thereon. A housing having a metal safety skirt 31 and a resilient shroud 32 mounted to the safety skirt to form a work chamber therebetween is positioned about the grinding assembly 27.

The vacuum system 14 has a vacuum fan and motor assembly 35 mounted to the upper platform 18 of the frame upright portion. The vacuum motor assembly 35 is coupled to a filtering cyclone 36 through a vacuum tube 37. The cyclone 36 is also coupled to a collector 39 through a second vacuum tube 40. The collector 39 is mounted to the safety skirt 31. The collector 39 has a semi-circular guide wall 43, a funnel portion 44 extending from guide wall 43, and a mounting bracket 45 having an unshown elongated slot though which a mounting bolt 46 extends. Two resilient sealing strips 47 are mounted to the bottom edge of the collector for substantially sealing the bottom of the collector from ambience. The funnel portion 44 of the collector is coupled to vacuum tube 40. The vacuum system 14 also includes a removable holding chamber 42 in the form of a pail. The holding chamber has a removable lid 41 for sealing the interior of the holding chamber from ambience once uncoupled from the cyclone 36. A peripheral sealing skirt 48 is mounted to safety skirt 31. The sealing skirt 48 is comprised of an overlapping, double layer of flaps 49 which extends from the safety skirt 31 to the underlying pavement in order to substantially seal the interior of the safety skirt from ambience. The sealing skirt 48 is retained in place by a circular band 51. The collector 39 also includes two debris guiding flanges 52 that extend inwardly from funnel portion 44.

The filtering cyclone 36 has an outer housing 55 having an inlet port 56 coupled to vacuum hose 40, an open bottom 57, and an open top 58 to which an annular cap 59 is mounted. A series of peripheral latches 60 retain the annular cap 59 in position. The annular cap 59 has a cylindrical mounting flange 61 defining an outlet port 62 that is to which vacuum tube 37 is mounted. The cyclone also has a funnel shaped interior conduit 64 having a bottom opening 65 and a top plate 66 having a circular array of passages 67 therethrough. An annular screen 69 is positioned upon the top plate 66 so as to overlay passages 67. The cyclone outer housing 55, cap 59 and conduit top plate 66 define a filter chamber 71. A tubular filter 72 is positioned within the filter chamber 71 upon top plate 66 within the circular array of passages 67. The interior of the filter is in fluid communication with outlet port 62.

Figure 2:
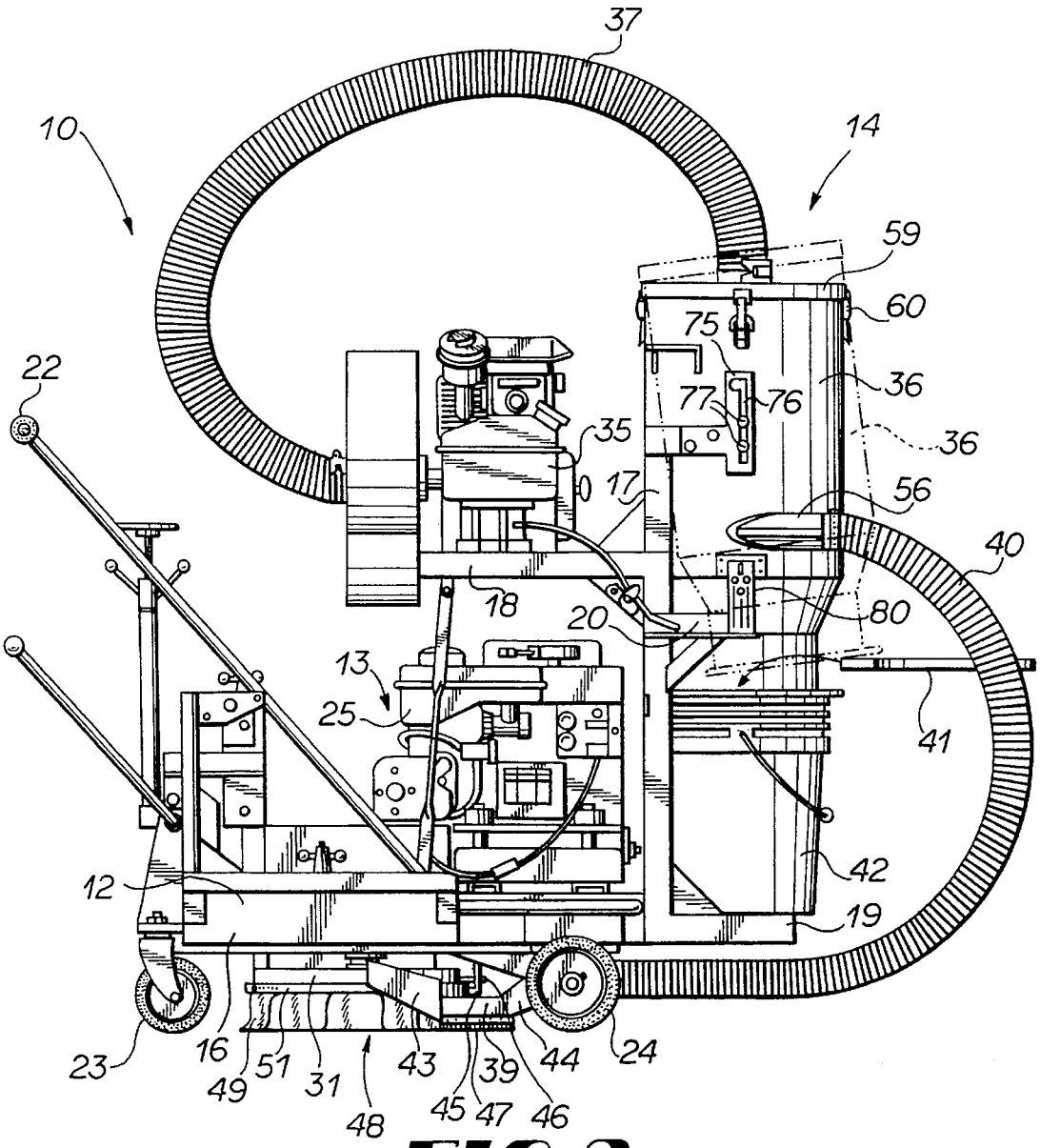
FIG. 2 is a side view of the pavement marking eradicator of FIG. 1.
Figure 3:
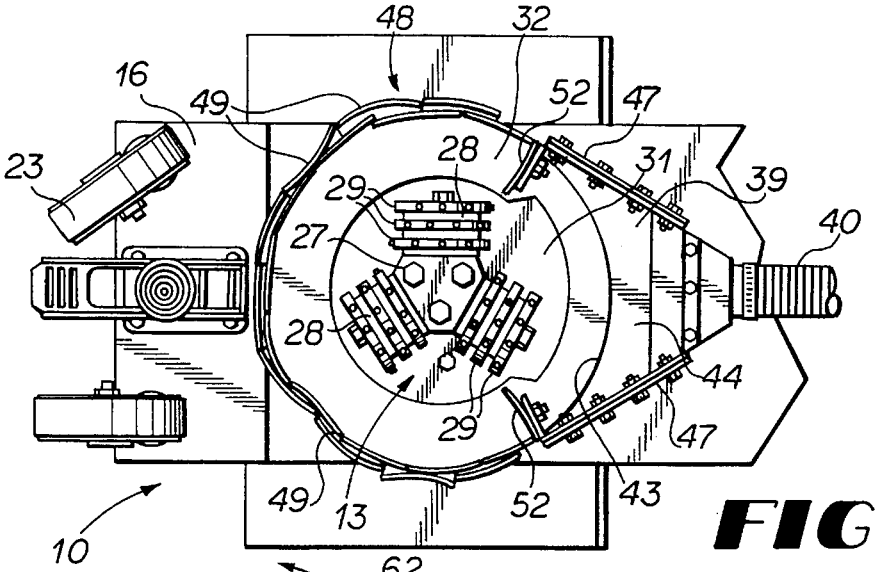
FIG. 3 is a bottom view of a portion of the pavement marking eradicator of FIG. 1.

The cyclone 36 is movably mounted to mounting arms 20 of the frame upright portion 17 through a pair of brackets 75 having an inverted L-shaped tracking slot 76 through which extends a pair of guiding posts 77 mounted to cyclone 36. The brackets 75 allow the cyclone to be moved between an operable position and an inoperable position indicated by phantom lines in FIG. 2. A pair of latches 80 mounted to the cyclone and adapted to be coupled to the upright portion of the frame maintain the cyclone in its operable position. Holding chamber 42 rests upon the lower platform 19 in sealed fluid communication with the cyclone.

In operation the eradicator 10 is manually pulled over the marked pavement area on a roadway. The movement of the grinding wheels 29 remove the pavement marking by chipping away the pavement marking from the surface of the pavement. The grinding action inherently removes a small portion of the pavement. The safety skirt 31 and shroud 32 restrict the chipped pavement marking and pavement particles, hereinafter collectively referred to as debris D, from being flung out from beneath the eradicator.

Figure 4:
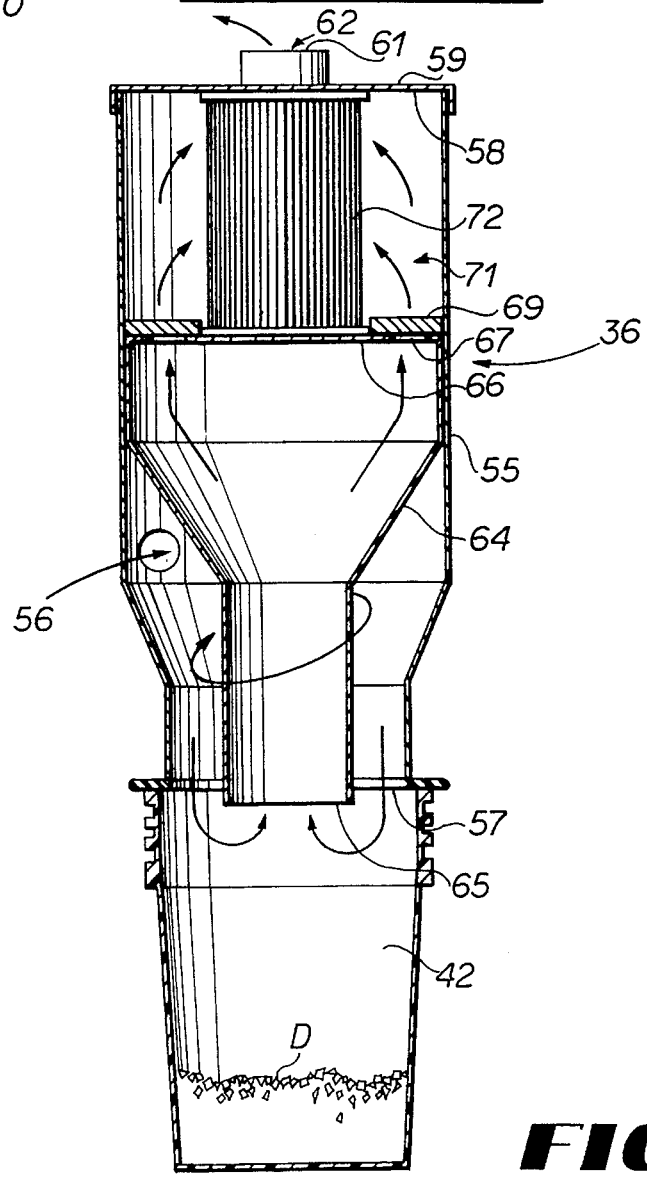
FIG. 4 is a cross sectional view of the cyclone and holding chamber of the pavement marking eradicator of FIG. 1.

The debris is drawn into the collector through the suctional air stream created by vacuum motor assembly 35 and the guidance of guide wall 43 and guide flanges 52. The debris is conveyed through vacuum tube 40 and through inlet port 56 into cyclone 36. Larger particles of debris fall through the open bottom 57 of cyclone 28 and into the holding chamber 42 as the airstream swirls down and about the interior conduit 64, as shown in FIG. 4. The air stream draws the finer particles of debris into the bottom opening 65 of the interior conduit 64. These particles continue upward through conduit 64 and exit through passages 67 in the top plate 66 pass into filter chamber 71. The larger of the finer particles are restricted by screen 69 with a limited amount of the smaller finer particles passing therethrough. These small finer particles are filtered from the air stream as they attempt to pass through filter 72. The airstream then exits the filter and filter chamber through outlet port 62 and is conveyed through vacuum tube 37 to vacuum motor assembly 35 and subsequently to ambience.

With extended use, the holding chamber 42 fills with large particles of debris and therefore must be replaced. To accomplish this the cyclone 36 is moved from its operable position to its inoperable position. This is done by releasing latches 80 and manually lifting the cyclone upward with its movement being guided by brackets 75. The air tight lid 41 is then mounted to the top of the holding chamber to limit subsequent exposure to the debris. The filter 72 should be cleaned periodically. This is done by unhooking latches 60 and removing cap 59 to gain access to the filter. The filter is then removed and placed in a plastic bag which is sealed to prevent dispersement of the filtered particles. A clean filter is then positioned within the filter chamber and the cap is remounted and latched.

Extended use of the eradicator over rough pavement causes the collector sealing strip 47 to become worn. This wearing of the sealing strips may be compensated by moving the collector downward. This is done by loosening mounting bolt 46 and sliding mounting bracket 45 downward to a proper position wherein the sealing collector strips are once again positioned closely adjacent the pavement. The mounting bolt 46 is then retightened to secure the position of the collector. The grinding wheels 29 also wear with extended use and therefore must be periodically replaced. The replacement of the worn grinding wheels with new wheels causes the collector to be elevated. To compensate for this the collector is moved downward, as previously described, to a position wherein the sealing strips are positioned closely adjacent the pavement.

It should be understood that the pivotable wheels 23 allow an operator to oscillate or pivot the eradicator to cover areas of pavement marking that may be broader than the grinding assembly, i.e. to create a grinding assembly swath large enough to enable the grinding assembly to eradicate the pavement marking.

It thus is seen that a pavement marking eradicator is now provided that grinds pavement marking, which may contain hazardous material, from the surface of pavement and safely collects the ground pavement marking for proper removal and storage.

While this invention has been described in detail with particular reference to the preferred embodiment thereof, it should be understood that many modifications, additions and deletions may be made thereto without departure from the spirit and scope of the invention as set forth in the following claims.

We claim:

1. An eradicator for removing pavement marking from the surface of pavement, the eradicator comprising a frame; wheel means mounted to said frame for movably supporting said frame upon the surface of the pavement; a housing defining a work chamber; a collector in fluid communication with said work chamber and adjustably mounted to said housing for adjusting the elevation of said collector above the pavement; grinding means mounted within said work chamber for grinding pavement marking from the surface of the pavement over which said work chamber passes; vacuum means supported upon said frame in fluid communication with said collector and said work chamber for vacuuming pavement marking debris ground from the surface of the pavement from said work chamber, said fluid communication being provided by a funnel portion of said collector coupled to a vacuum tube in communication with said vacuum means; and storage means supported upon said frame for collecting and storing vacuumed pavement marking debris.

2. The eradicator of claim 1 further comprising guide means for guiding pavement marking ground from the surface of the pavement within said work chamber into said collector.

3. The eradicator of claim 1 wherein said wheel means includes at least one pivotable wheel.

4. The eradicator of claim 1 wherein said vacuum means comprises filtering means for filtering pavement marking debris.

5. The eradicator of claim 4 wherein said filtering means comprises a cyclone.

6. The eradicator of claim 5 wherein said cyclone is mounted for movement between a position engaging said storage means and a position disengaging said storage means.

7. The eradicator of claim 6 wherein said storage means is releasibly mounted to said cyclone.

8. The eradicator of claim 7 wherein said storage means has a removable lid.

9. The eradicator of claim 5 wherein said cyclone includes filtering material for filtering particles from an airstream flowing through said cyclone created by said vacuum means.

10. The eradicator of claim 1 wherein said collector has resilient sealing strips for substantial sealing engagement with the surface of pavement.

11. The eradicator of claim 1 wherein said collector has an open bottom closely adjacent the surface of pavement.

12. A pavement marking eradicator for removing pavement marking from pavement, the eradicator comprising a skirt at least partially defining a work chamber; a plurality of wheels supporting said skirt for movement over the pavement; a collector in fluid communication with said work chamber and adjustably mounted to said skirt for adjusting the elevation of said collector above the pavement; a grinder positioned within said collector and said work chamber; a vacuum system supported by said wheels, said vacuum system being in fluid communication with said work chamber, said fluid communication being provided by a funnel portion of said collector, coupled to a vacuum tube in communication with said vacuum system and a storage chamber supported by said wheels, said storage chamber being in fluid communication with said vacuum system; whereby pavement marking ground from the surface of the pavement by the grinder is pulled into the vacuum system and deposited into the storage chamber for collection and subsequent disposal.

13. The eradicator of claim 12 further comprising guide means for guiding pavement marking ground from the surface of the pavement within said work chamber into said collector.

14. The eradicator of claim 12 wherein at least one said wheel is pivotable.

15. The eradicator of claim 12 wherein said storage chamber is removable.

16. The eradicator of claim 15 wherein said storage chamber has a removable lid.

17. The eradicator of claim 12 wherein said vacuum system comprises a cyclone.

18. The eradicator of claim 17 wherein said cyclone is mounted for movement between a position engaging said storage chamber and a position disengaging said storage chamber.

19. The eradicator of claim 17 wherein said cyclone includes filtering material for filtering particles from created by said vacuum system.

20. The eradicator of claim 12 wherein said collector has resilient sealing strips for substantial sealing engagement with the surface of pavement.

21. The eradicator of claim 12 wherein said collector has an open bottom closely adjacent the surface of pavement.

* * * * *